US008645051B2

(12) United States Patent
Walthers

(10) Patent No.: US 8,645,051 B2
(45) Date of Patent: Feb. 4, 2014

(54) COEFFICIENT OF VOLATILITY TOOL

(76) Inventor: Gregory S Walthers, Chicago, IL (US)

( * ) Notice: Subject to any disclaimer, the term of this patent is extended or adjusted under 35 U.S.C. 154(b) by 0 days.

(21) Appl. No.: 13/525,255

(22) Filed: Jun. 15, 2012

(65) Prior Publication Data

US 2012/0323472 A1 Dec. 20, 2012

Related U.S. Application Data

(60) Provisional application No. 61/497,491, filed on Jun. 15, 2011.

(51) Int. Cl.
*G08G 1/00* (2006.01)

(52) U.S. Cl.
USPC ..... 701/117

(58) Field of Classification Search
USPC ..... 701/1, 117, 118, 123; 340/441
See application file for complete search history.

(56) References Cited

U.S. PATENT DOCUMENTS

| | | | | |
|---|---|---|---|---|
| 4,593,357 | A * | 6/1986 | Van Ostrand et al. | 701/1 |
| 6,988,033 | B1 * | 1/2006 | Lowrey et al. | 701/123 |
| 2005/0096836 | A1 * | 5/2005 | Minami et al. | 701/123 |
| 2008/0306678 | A1 * | 12/2008 | Miyawaki | 701/118 |
| 2009/0251304 | A1 * | 10/2009 | Saito et al. | 340/441 |

* cited by examiner

*Primary Examiner* — Tuan C. To
*Assistant Examiner* — Aaron L Troost
(74) *Attorney, Agent, or Firm* — Richards Patent Law P.C.

(57) ABSTRACT

A system for monitoring a vehicle's contribution to the efficiency of flow and throughput in traffic includes: a computation unit that determines the fluctuation in velocity of the vehicle over a time or a distance; and a notification unit that provides a notification related to the determined fluctuation in velocity of the vehicle. The notification unit may be a display that displays a visual representation of the fluctuation in velocity of the vehicle over a period of time or over a distance. The notification unit may provide an audible notification related to the fluctuation in velocity of the vehicle. The system may further include a sensor that determines the velocity of the vehicle and provides the velocity to the computation unit.

20 Claims, 7 Drawing Sheets

COEFFICIENT OF VOLATILITY TOOL

CROSS-REFERENCE TO RELATED APPLICATIONS

This application claims the benefit of U.S. Provisional Application No. 61/497,491, filed on Jun. 15, 2011, the entirety of which is incorporated herein by reference.

BACKGROUND OF THE INVENTION

The present subject matter relates to an automotive electronic system, device, and method for obtaining information about the overall system efficiency of a driver's operation of a single automobile. More particularly, the invention relates to a system for producing information based on a new automobile metric, the Coefficient of Volatility (COV), which represents an expression of the efficiency of a driver's operation of an automobile, relative to the system it is within, over measured intervals of time and distance. Information that conveys real-time information about a driver's efficiency while operating an automobile will aid driver in improving his operational system efficiency, thereby aiding the reduction of automobile congestion on streets, highways, and thoroughfares. This driving efficiency information may also be used by fleets of vehicles operating within congested roadways to actively combat traffic congestion.

The demand placed on our highways, streets, and thoroughfares continues to reach greater levels. The Texas Transportation Institute's 2010 Urban Mobility Report notes that congestion costs are increasing. The report further indicates that the congestion "invoice" for the cost of extra time and fuel in 439 urban areas was: in 2009-$115 billion; in 2000-$85 billion; in 1982-$24 billion. The report believes that "congestion wastes a massive amount of time, fuel, and money." Indicative of the waste associated with congestion, the report notes the waste in 2009 included the following: 3.9 billion gallons of fuel (equivalent to 130 days of flow in the Alaska pipeline); 4.8 billion hours of extra time (equivalent to the time Americans spend relaxing and thinking in 10 weeks); $115 billion of delay and fuel cost (the negative effect of uncertain or longer delivery times, missed meetings, business relocations and other congestion-related effects are not included); $33 billion of the delay cost was the effect of congestion on truck operations; this does not include any value for the goods being transported in the trucks. It follows that an automotive metric, in addition to those available (e.g., velocity and acceleration), that provides greater insight into the system efficiency of operation for an automobile will lead to greater awareness of the driver's habits. Therefore, a greater awareness can lead to change in habits, which collectively make an impact on traffic flow and reduce congestion. Further, fleets of vehicles may be used to actively combat traffic congestion by employing driving techniques shown to relieve traffic congestion.

Accordingly, there is a need for a system, method, and device that provides an improved way to measure system efficiency of operation of an automobile, which can be used to reduce traffic and congestion on highways, streets, and thoroughfares.

BRIEF SUMMARY OF THE INVENTION

The subject matter provided herein addresses these issues by providing a system, device, and method for producing a new automotive metric, the Coefficient of Volatility, which represents an expression of the system efficiency of a driver's operation for a single automobile over measured intervals of time and distance.

COV short for Coefficient of Volatility, represents the value obtained from the computation of a mathematical equation, in accordance with this invention, that considers fluctuation in velocity of a subject automobile over measured intervals of time and distance. The equation has multiple variations that produce a value representing the same concept of the Coefficient of Volatility. The COV represents an expression of the system efficiency of a driver's operation for a single automobile. A COV metric represents a value based on an expression of the COV in relation to another unit of measurement, such as time or distance.

It is contemplated that there are numerous ways in which the COV metric may be used within a system. One example includes providing a stand-alone device solely devoted to the COV and other COV metrics. A second example includes providing COV information in an integral display on a vehicle's existing dashboard. A third example includes providing a COV information readout through a third party software system. In each example, the data used to calculate the COV may be collected through wired or wireless communications.

In one embodiment, a system producing COV metric information includes a hand-held, portable electronic device (COV device), equipped with a power source and hardware that supports the use of a commercially available cable to connect the device to an automobile's OBD-II system through an OBD-II connector. The COV device has an electronic display that is enabled to display COV metric information that includes the COV, COV per unit of time, COV per unit of distance, and COV per unit of time per unit of distance. In addition, the device has functional units including an OBD-II access unit, a COV computation unit, a COV storage unit, and a COV display unit. The OBD-II access unit provides the COV device with access to data from the automobile's OBD-II system utilizing readily known processes and commercially available tools. The COV computation unit is responsible for computing the COV metric information from the OBD-II system data. The COV storage unit is responsible for storage and retrieval of OBD-II system data and COV metric information. Lastly, the COV display unit is responsible for display of the COV metric information on the COV device's display. The COV device when powered on provides continuous COV metric information when it is operatively connected to the OBD-II system of an automobile that is in operation.

In use, a driver powers on a COV device and connects the device to his automobile via the OBD-II connector. Upon operation of the automobile, the COV device begins to access data from the OBD-II system, which it uses to produce COV metric information. The COV device accesses the data through the OBD-II access unit. The data is stored via the COV storage unit, and is provided to the COV process unit to produce COV metric information in accordance with one variation of an equation that produces the COV. The COV metric information is stored in the COV device by using the COV storage unit. The COV display unit displays the COV metric information to the COV device's display. The driver views the COV device's display to obtain the COV metric information, which the driver can then use to assess the system efficiency of his driving with respect to operation of his automobile. The driver can adjust his operation of the automobile to a more system-efficient manner and is able to verify this by the COV metrics updated on the COV device's display. Similarly, fleets of vehicles can be deployed using COV information to actively combat traffic congestion and/or document the correlation between lower COV numbers and lower travel times across congested urban corridors, thus providing a service to parties interested in reducing traffic congestion and studying the effects of COV on traffic congestion.

In another embodiment, the COV device is represented as described in the prior embodiment and further includes communication capabilities that support a wide variety of communication protocols, designed to facilitate communication with external devices for the purpose of sharing COV metric information. The use of external devices equipped to communicate with a COV device provide greater support to those interested in regulating, managing, and understanding traffic, and the associated problems such as congestion. In the current embodiment, a pre-existing traffic management system equipped with an external device, operable to communicate with a COV device, communicates with an automobile equipped with a COV device to obtain COV metric information that the traffic management system can use for congestion analysis. In support of the communication capabilities afforded by the COV device, the device further includes a COV communication unit that handles the COV device's communication of COV metric information to other electronic devices. In use, this embodiment performs identically to the previous embodiment, resulting in the production of COV metric information. Additionally, the COV device communicates the COV metric information to the external device associated with the traffic management system. The external device's communication capabilities enable its communication with the COV device through available communication protocols. In this embodiment, both devices are equipped with RFID functionality. The traffic management system in this embodiment further includes a feebate system, used by the traffic management system to combat traffic congestion by rewarding drivers in congested systems based on their COV metric information. To combat traffic congestion, the reward increases as the COV value decreases due to operation of the automobile more whole system efficient manner, thereby serving as an incentive to efficient operation. One goal of such an implementation is to lessen traffic congestion by improving the system efficiency of individual drivers within the system. Alternatively, the reward system may be implemented as a toll or punishment type system.

In one example, a driver operating an automobile equipped with a COV device enters a special zone regulated by a traffic management system that includes a feebate system and is equipped with an external device operable to communicate with the COV device. When the driver exits the zone the automobile communicates the COV metric information to the traffic management system, which is provided to the feebate system to compute the automobile's reward. The reward increases as the COV value decreases. Individual drivers that positively impact the traffic congestion system (help reduce congestion) are incentivized to do so and their contribution can be actively measured using this system. The COV device communicates, via RFID, the automobile's most recent COV metric information to the external device connected to the traffic management system when both devices are in close proximity to one another enabling RFID communication. The computed reward and the corresponding COV metric information are then displayed on an electronic display provided on the external device of the traffic management system. A monetary incentive can be transferred to an account that is set up by the drivers using the COV device.

The use of the COV metric information by the traffic management system is yet another example where the COV metric information can be used to help lessen traffic congestion. Rewards for driving in a system-efficient manner will incentivize drivers to positively impact traffic congestion systems. Increased numbers of individual drivers positively impacting traffic congestion systems may result in less severe commutes.

It is further contemplated that the COV metric information may be used in the operation of unmanned vehicles, robotic vehicles and other vehicles that are not human operated/driven. It is believed that the COV metric may be an important element of the artificial intelligence algorithm for non-human operators.

In one embodiment, a system for monitoring a vehicle's contribution to the efficiency of flow and throughput in traffic includes: a computation unit that determines the fluctuation in velocity of the vehicle over a time or a distance; and a notification unit that provides a notification related to the determined fluctuation in velocity of the vehicle. The notification unit may be a display that displays a visual representation of the fluctuation in velocity of the vehicle over a period of time or over a distance. The notification unit may provide an audible notification related to the fluctuation in velocity of the vehicle. The system may further include a sensor that determines the velocity of the vehicle and provides the velocity to the computation unit. The sensor may communicate with the computation unit through an OBD-II system. In some examples, the computation unit and the notification unit are integrated into the vehicle. In other examples, the computation unit and the notification unit are provided in a stand-alone device. In still other examples, the computation unit and notification unit are embodied in a mobile application provided in a mobile device. The system may further include a communication unit adapted to communicate with another electronic device, such as, an element of a traffic management system.

In one embodiment, a method of monitoring vehicle efficiency includes the steps of: calculating the fluctuation in velocity of the vehicle over a time or a distance as determined by the sensor; and displaying a visual representation of the calculated fluctuation in velocity of the vehicle. In some examples, the step of displaying a visual representation of the calculated fluctuation in velocity of the vehicle may include displaying a visual representation of the fluctuation of the vehicle over a period of time. In other examples, the step of displaying a visual representation of the calculated fluctuation in velocity of the vehicle may include displaying a visual representation of the fluctuation of the vehicle over a distance. The method may further include a step of providing a sensor that determines the velocity of the vehicle and provides the velocity to a computation unit that calculates the fluctuation in velocity of the vehicle over a time or a distance as determined by the sensor. The sensor may communicate with the computation unit through an OBD-II system. The step of calculating the fluctuation in velocity of the vehicle over a time or a distance as determined by the sensor may be performed by a computation unit and the step of displaying a visual representation of the calculated fluctuation in velocity of the vehicle may be performed by a display, and the computation unit and the display may be integrated into the vehicle. The step of calculating the fluctuation in velocity of the vehicle over a time or a distance as determined by the sensor may be performed by a computation unit and the step of displaying a visual representation of the calculated fluctuation in velocity of the vehicle may be performed by a display, and the computation unit and the display may be provided in a stand-alone device. The step of calculating the fluctuation in velocity of the vehicle over a time or a distance as determined by the sensor may be performed by a computation unit and the step of displaying a visual representation of the calculated fluctuation in velocity of the vehicle may be performed by a display, and the computation unit and the display may be embodied in a mobile application provided in a mobile device. The method may further include the step of communicating the calculated fluctuation in velocity of the vehicle with another electronic device, such as an electronic device included in a traffic management system.

It is therefore an advantage of the invention provided herein to provide an automobile driver with valuable information that allows the driver to operate an automobile more efficiently.

It is another advantage of the invention provided herein to reduce traffic congestion and improve automobile traffic systems by providing a way for automobile drivers to improve their ability to drive more efficiently in a manner benefiting the entire system.

It is yet another advantage of the invention provided herein to provide a new automotive metric that expresses the system efficiency of a driver's operation of an automobile.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

FIG. 2 ("Smooth") is a graph illustrating smooth lines that depict a more efficient operation of an automobile, relative to the COV value determined for other instances of operation for the same automobile over the same road segment as illustrated by FIGS. 3 and 4. The efficient operation is represented by a lower COV value compared to the values calculated in FIGS. 3 and 4 with respect to change in speed over measured intervals of time for the same road segment as FIGS. 3 and 4.

FIG. 3 ("Less Smooth") is a graph illustrating less smooth lines that depict a less efficient operation of an automobile, relative to the COV value determined for other instances of operation for the same automobile over the same road segment as illustrated by FIGS. 2 and 4. The less efficient operation is represented by an increase in the COV value compared to the value calculated in FIG. 2 with respect to change in speed over measured intervals of time for the same road segment.

FIG. 4 ("Turbulent") is a graph illustrating turbulent lines that depict an inefficient operation of an automobile, relative to the COV value determined for other instances of operation for the same automobile over the same road segment as illustrated by FIGS. 2 and 3. The inefficient operation is represented by a remarkable increase in the COV value compared to the values calculated in FIGS. 2 and 3 with respect to change in speed over measured intervals of time for the same road segment.

DETAILED DESCRIPTION OF THE INVENTION

Figure 1:
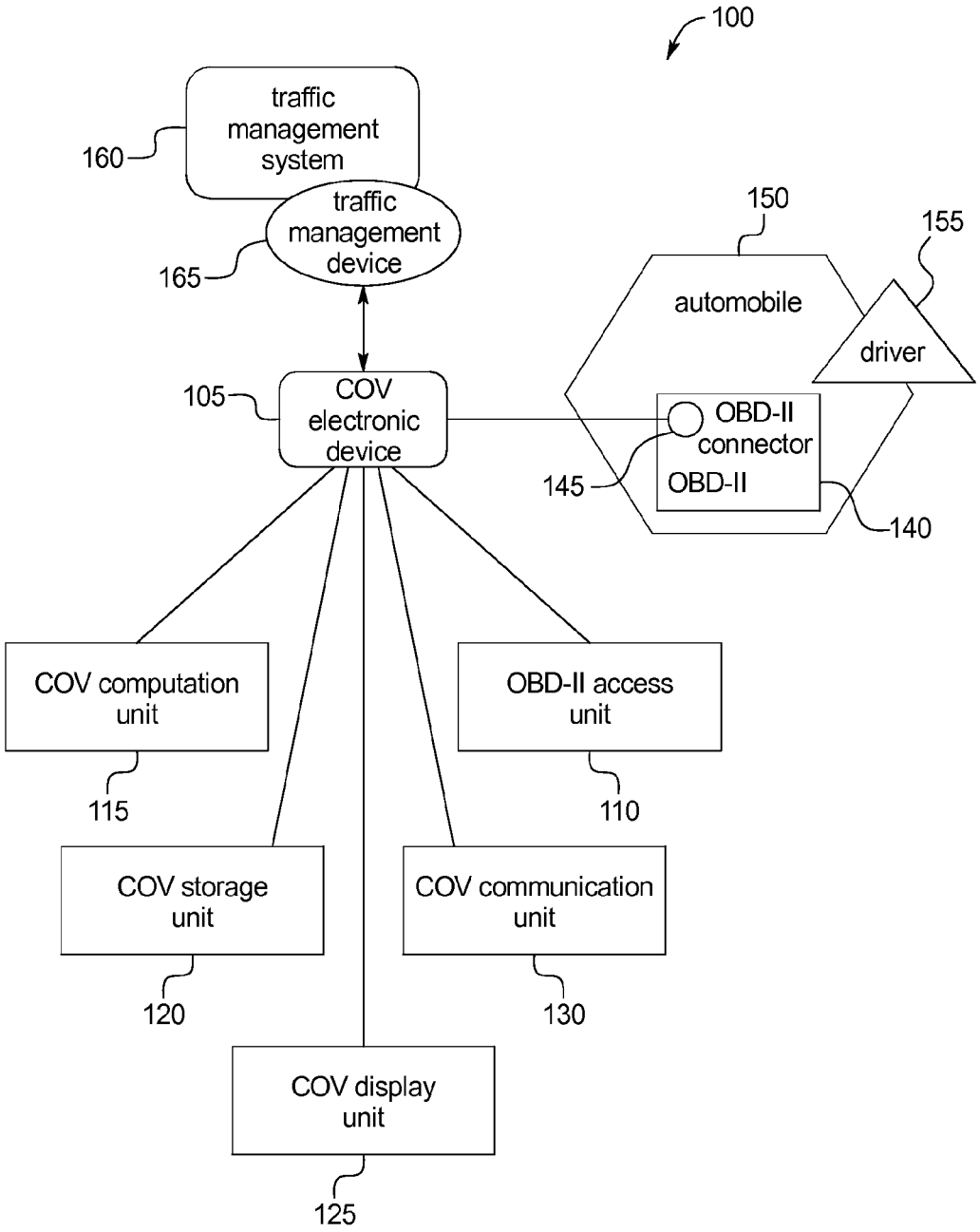
FIG. 1 is a block diagram illustrating a system 100 for producing COV metric information facilitated by an electronic device connected to an OBD-II system in an automobile.

The present invention relates to a system for using a new automotive metric, Coefficient of Volatility (herein referred to as COV), which represents the system efficiency of a driver's operation for a single automobile over measured intervals of time and distance. The objects of the invention, which will be apparent from the following detailed description, have been attained from discovery of a new automotive metric COV, which represents the system efficiency of a driver's operation of a single automobile over measured intervals of time and distance and is produced by computation of real-time information obtained from an OBD-II system in an automobile.

An object of the present invention is to provide a system for obtaining COV metric information from an electronic device adapted to produce COV information by use of data obtained from an OBD-II system in an automobile.

Another object of the present invention is to provide a method for producing COV metric information through use of an electronic device that computes the information based on the data obtained from an OBD-II system in an automobile.

Yet another object of the present invention is to provide an electronic device that produces COV metric information using data obtained from an OBD-II system in an automobile.

In one embodiment, a system for monitoring a vehicle's contribution to the efficiency of flow and throughput in traffic includes: a computation unit that determines the fluctuation in velocity of the vehicle over a time or a distance; and a notification unit that provides a notification related to the determined fluctuation in velocity of the vehicle. The notification unit may be a display that displays a visual representation of the fluctuation in velocity of the vehicle over a period of time or over a distance. The notification unit may provide an audible notification related to the fluctuation in velocity of the vehicle. The system may further include a sensor that determines the velocity of the vehicle and provides the velocity to the computation unit. The sensor may communicate with the computation unit through an OBD-II system. In some examples, the computation unit and the notification unit are integrated into the vehicle. In other examples, the computation unit and the notification unit are provided in a stand-alone device. In still other examples, the computation unit and notification unit are embodied in a mobile application provided in a mobile device. The system may further include a communication unit adapted to communicate with another electronic device, such as, an element of a traffic management system.

In one embodiment, a method of monitoring vehicle efficiency includes the steps of: calculating the fluctuation in velocity of the vehicle over a time or a distance as determined by the sensor; and displaying a visual representation of the calculated fluctuation in velocity of the vehicle. In some examples, the step of displaying a visual representation of the calculated fluctuation in velocity of the vehicle may include displaying a visual representation of the fluctuation of the vehicle over a period of time. In other examples, the step of displaying a visual representation of the calculated fluctuation in velocity of the vehicle may include displaying a visual representation of the fluctuation of the vehicle over a distance. The method may further include a step of providing a sensor that determines the velocity of the vehicle and provides the velocity to a computation unit that calculates the fluctuation in velocity of the vehicle over a time or a distance as determined by the sensor. The sensor may communicate with the computation unit through an OBD-II system. The step of calculating the fluctuation in velocity of the vehicle over a time or a distance as determined by the sensor may be performed by a computation unit and the step of displaying a visual representation of the calculated fluctuation in velocity of the vehicle may be performed by a display, and the computation unit and the display may be integrated into the vehicle. The step of calculating the fluctuation in velocity of the vehicle over a time or a distance as determined by the sensor may be performed by a computation unit and the step of displaying a visual representation of the calculated fluctuation in velocity of the vehicle may be performed by a display, and the computation unit and the display may be provided in a stand-alone device. The step of calculating the fluctuation in velocity of the vehicle over a time or a distance as determined by the sensor may be performed by a computation unit and the step of displaying a visual representation of the calculated fluctuation in velocity of the vehicle may be performed by a display, and the computation unit and the display may be embodied in a mobile application provided in a mobile device. The method may further include the step of communicating the calculated fluctuation in velocity of the vehicle with another electronic device, such as an electronic device included in a traffic management system.

FIG. 1 illustrates an example of a system 100 for producing COV metric information through a COV electronic device (COV device) 105. COV, which represents the Coefficient of Volatility, represents a value obtained from the computation of a mathematical equation, in accordance with this invention, that considers fluctuation in velocity of the subject automobile over measured intervals of time and/or distance. The COV represents the system efficiency of a driver's operation of a single automobile from which the data is used to compute the COV. The equation has multiple variations to produce a value that represents the same expression of the COV. In one example, the equation is:

$$CoV = \sum_{n=0}^{[t/5]} |1 - (V_{n+1} / V_n)|$$

CoV=Coefficient of Volatility n=reading t=total elapsed time vn=velocity at reading n In another example, the equation is:

$$CoV = f/60 \sum_{r=0}^{[t/f]} |1 - (V_r / V_{r+1})|$$

CoV=Coefficient of Volatility r=reading f=frequency of reading (seconds)

t=total elapsed time of run (seconds)

v=velocity

While these examples are representative of preferred embodiments of the equation, it is understood that there may be many examples of equations used to calculate COV.

A COV metric represents a value based on an expression of the COV in relation to another unit of measurement, such as time or distance. One COV metric is COV per unit of time (COV time), where time can include seconds, minutes, or hours. Another COV metric is COV per distance (COV distance), where distance can include feet, miles, or kilometers.

Figure 2:
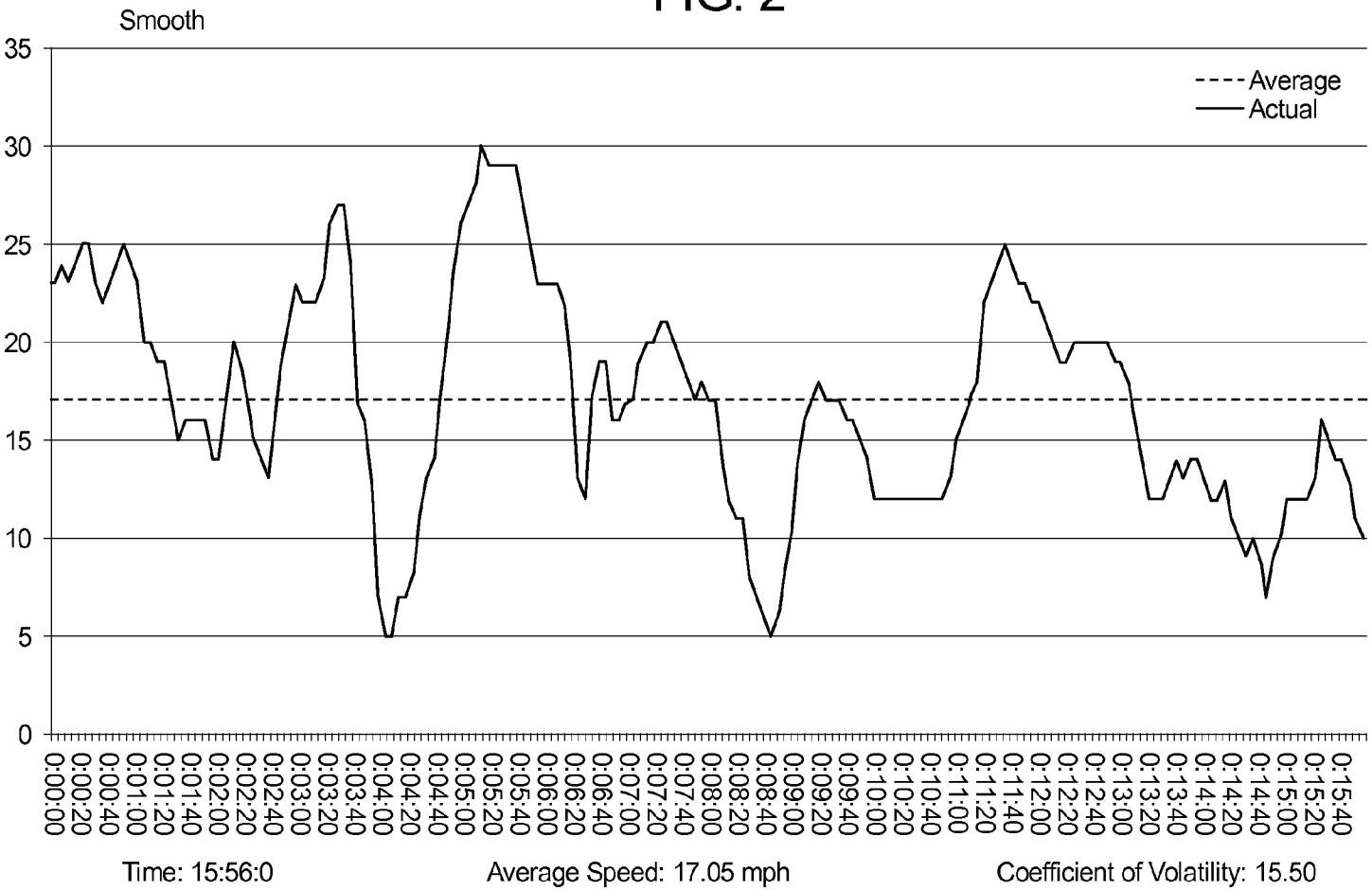
FIGS. 2-4 represent a collection of graphs ("Smooth", "Less Smooth", and "Turbulent") that collectively reflect the resultant change in efficiency for operation of an automobile as represented by the COV value, in accordance with the invention. Each graph represents a separate instance of operation for the same automobile traveling over the same road segment.
Figure 3:
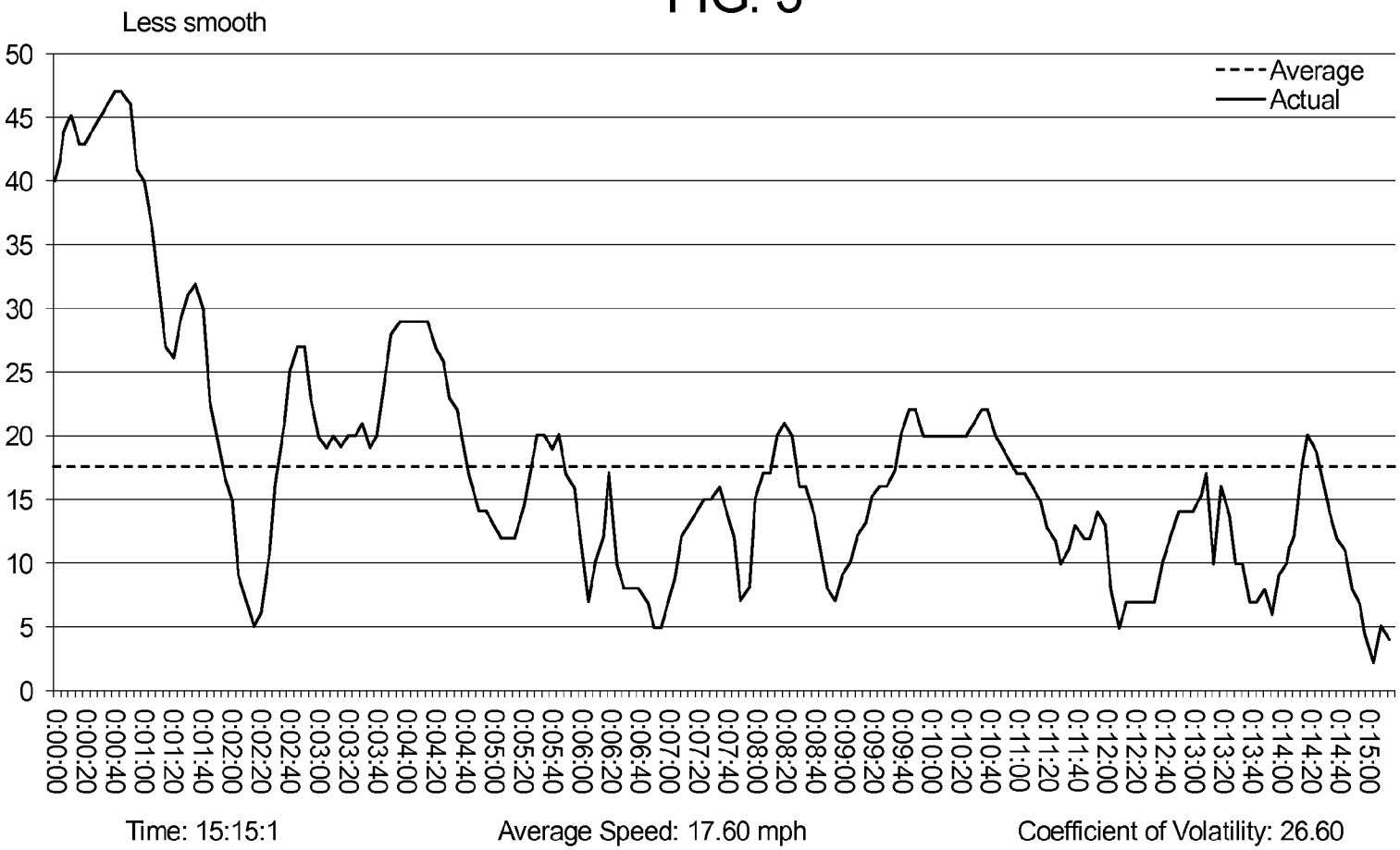
Figure 4:
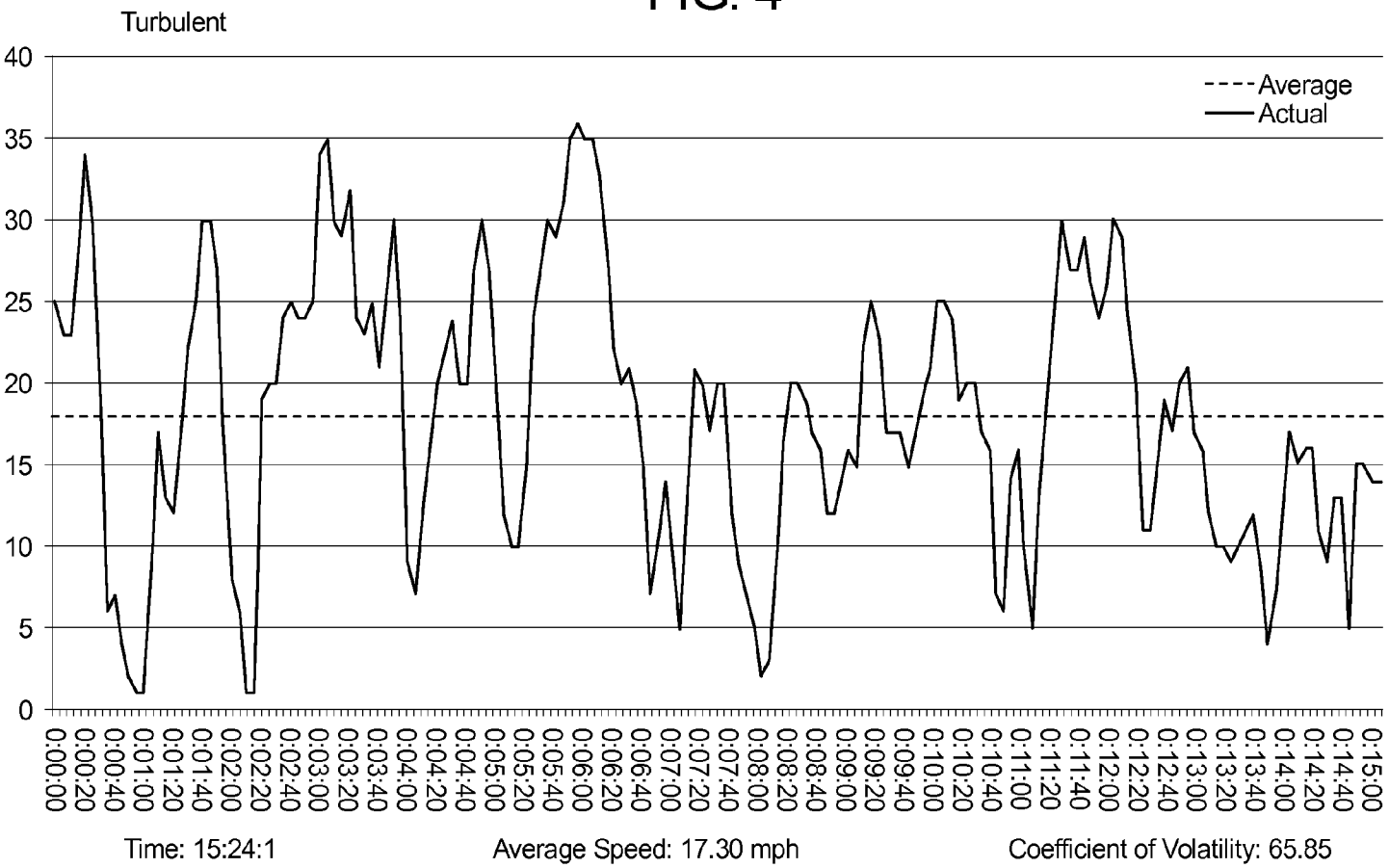

The COV value in inversely related to the system efficiency of operation for a single automobile, such that as the system efficiency of operation increases, the COV value decreases. FIGS. 2-4 illustrate the COV value with respect to exemplary measurements for three instances of operation for the same automobile over the same segment of road produced by a different degree of system efficiency for each instance. FIG. 2 represents the instance when the automobile was operated in a more efficient manner, as represented by a low COV value, than the other instances of operation represented in FIG. 3 and FIG. 4. The low COV value is illustrated in the graph by the "smooth", or relatively less jagged, lines between intervals of time depicting the relatively small fluctuations in velocity over time. FIG. 2 is a graph of speed in mph (y-axis) versus time (h.mm:ss). The data was collected while driving in a system-efficient manner where a very large headway, uncommon in traffic congestion, was used between the research vehicle and the next vehicle.

In FIG. 3, the automobile was operated less efficiently that its operation shown in FIG. 2, however with a greater efficiency than the instance shown by FIG. 4. The COV value, although low, is greater than the COV value in FIG. 2, and is illustrated in the graph by the "less smooth", or more jagged, lines between the intervals of time showing increased fluctuations in velocity over time due to decrease in system efficiency. FIG. 3 is another graph of speed versus time traveled through the same road segment as the graph in FIG. 2. The COV for this run was higher than the run from FIG. 2. Once again, for this run care was taken to leave a large headway between the research vehicle and the next vehicle in the traffic congestion. Implementing this technique is a difficult skill and highly counter-instinctive.

In FIG. 4, the automobile was operated in a manner that is inefficient in comparison to the two prior instances shown in FIG. 2 and FIG. 3. The inefficiency is illustrated by the "turbulent", or significantly jagged, lines between the intervals of time marking a significant increase in fluctuation of velocity over time. This is representative of the behavior of the striking majority of drivers within congested systems. FIG. 4 is a graph of speed versus time where data was taken from the same road segment as FIGS. 2 and 3. In all three of these examples, the average speed for the runs was nearly the same. However, during this run, the research vehicle mimicked the headway that the vehicle in front of the research vehicle used with the vehicle in front of it. In this example, the COV was very high. High COVs are detrimental to the traffic system. The COV is a controllable value.

Figure 5:
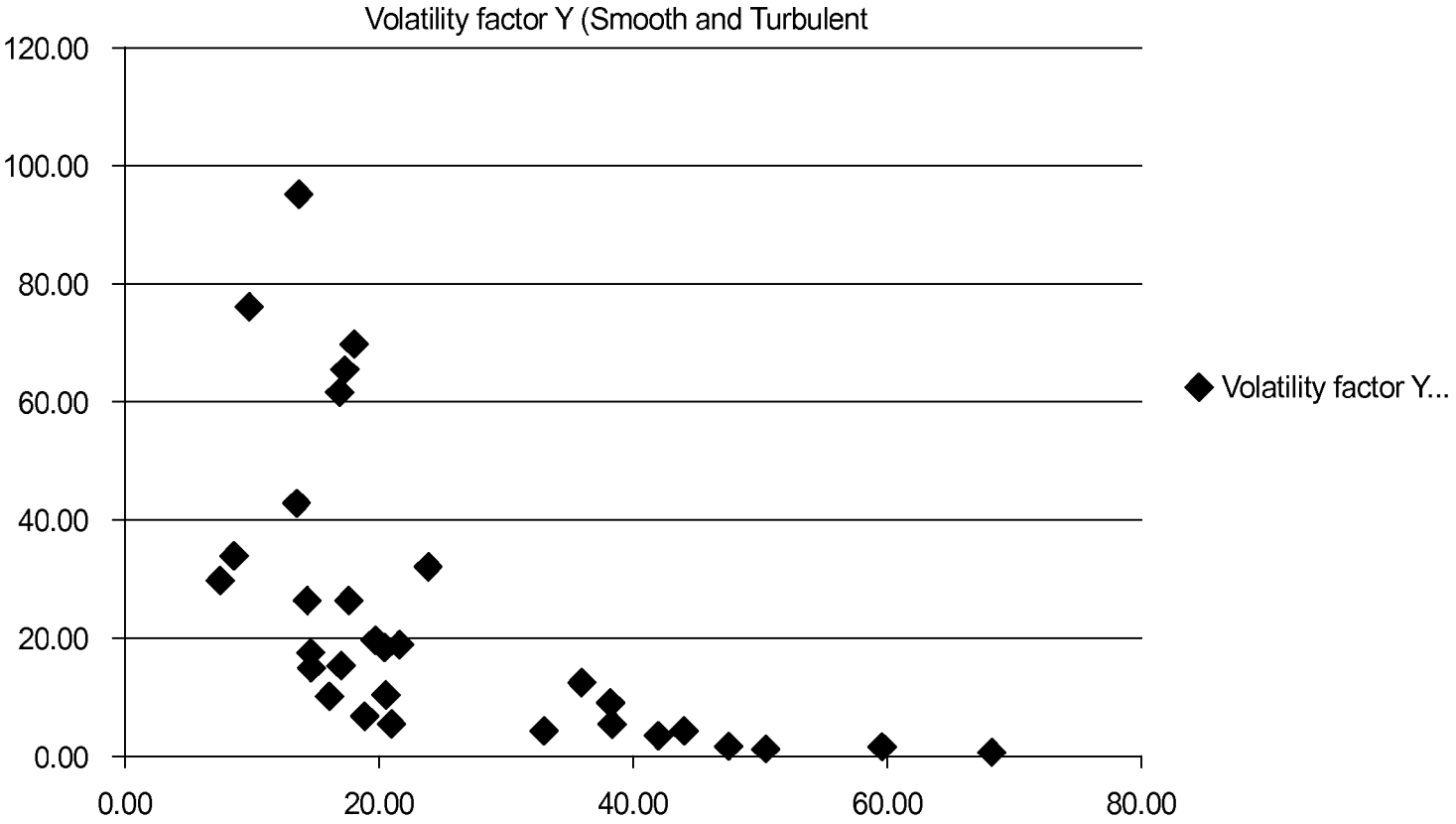
FIG. 5 is a graph illustrating experimental data of measured COV factors at various speeds.

FIG. 5 is a graph of COV (y-axis) versus average speed for a road segment in mph (x-axis). This graph demonstrates a distinctive pattern where instinctive driving habits can be quantified by the COV along the top side of the curve while system-efficient (counter-instinctive and uncommon in traffic congestion) driving methods fall well below the upper limits of the curve. COV is a controllable quantity in all congested traffic systems and lower COVs mimic free-flowing conditions as in all free-flowing conditions the COV is very low.

Figure 6:
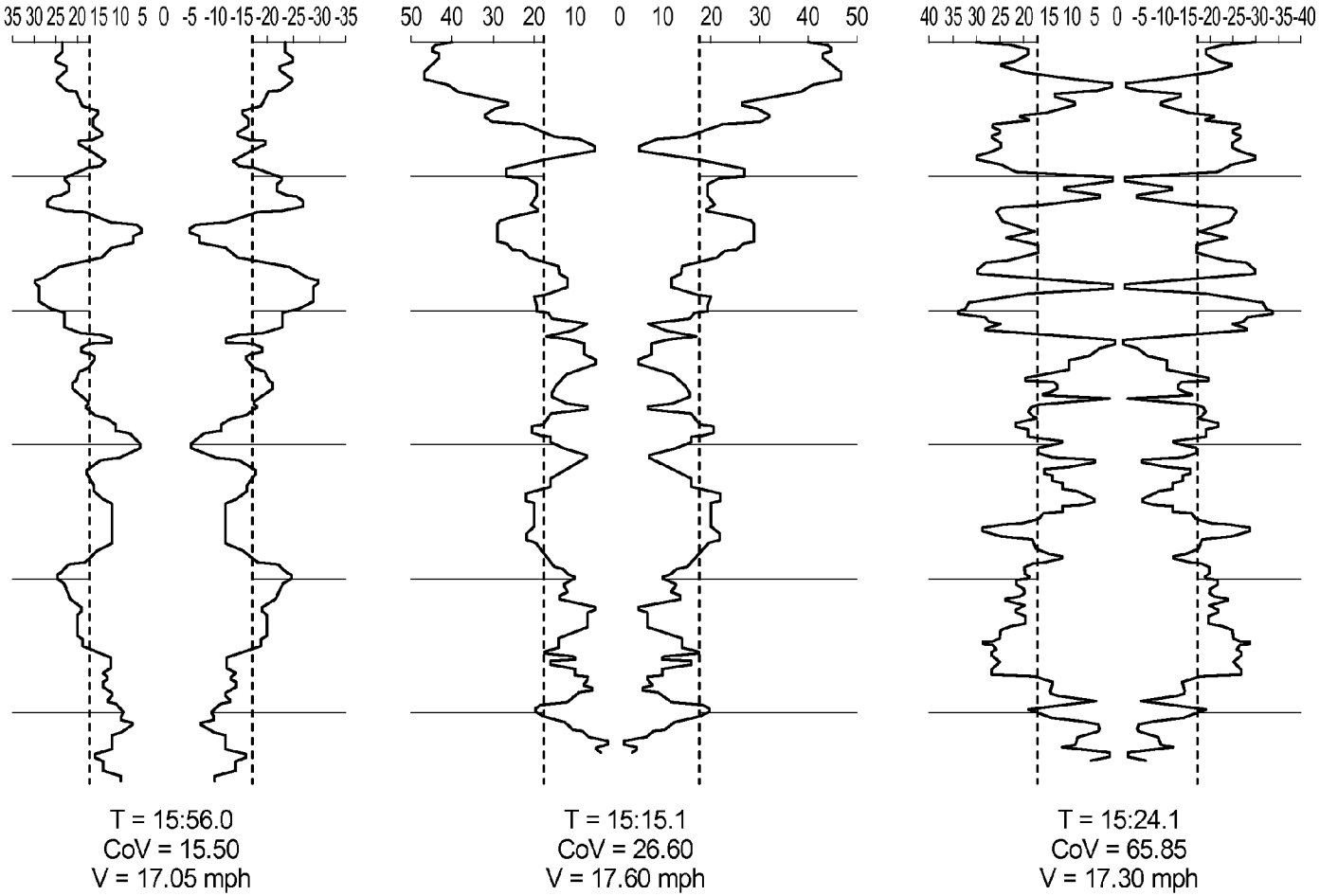
FIG. 6 contains set of three graphs, each representing the graphs of FIGS. 2-4 starting from the left-most graph, which in combination illustrate the relation between the COV value and traffic flow behavior, such that a lower COV produces optimized traffic flow in accordance with known model traffic flow behavior.

And finally, FIG. 6 represents a side-by-side comparison of the three instances illustrated in the FIGS. 2-4, starting from FIG. 2 on the left in numerical order. In accordance with known model traffic flow behavior, the combination of the graphs in FIGS. 2-4 illustrate the correlation between the COV value and traffic flow, such that a lower a COV value results in a greater optimized traffic flow. FIG. 6 draws upon the correlation between traffic flux and flow velocity. Traffic engineers sometimes use the analogy of pouring rice through a tube to model traffic flow. Each "tube" above represents the overall system right of way available upstream of the research vehicle for the three runs depicted in FIGS. 2-4. Which tube above will allow the most rice to pass through?

When the system 100 is in use, the COV device 105 is connected to an automobile 150 equipped with an OBD-II diagnostic system (OBD-II) 140, which supports access to the system 140 through an OBD-II connector 145.

The OBD-II 140 is a computer-based system, well known in the art of automotive electronics, found in most modern automobiles to provide access to hundreds of automobile parameters, including data representing operation of the automobile (e.g., velocity) with respect to measurable intervals of time or distance. The connector 145 facilitates a connection between the COV device and the OBD-II 140, necessary for the COV device 105 to obtain access to OBD-II's 140 data. Automobiles with an OBD-II system have an ODB-II connector that is easily accessible, such as through the automobile's passenger compartment, which allows an electronic device to connect to the OBD-II system with a commercially available cable.

The COV device 105 may be any type of electronic device with a power source and electronic display to show the COV metric information calculated by the COV device 105. The COV device 105 displays real-time COV metric information, such as the COV, COV per unit of time (e.g., seconds or minutes), and COV per distance (e.g., miles or feet) as produced by the COV device 105 in this invention. The COV device 105 can be utilized in an automobile in a variety of ways. Some ways include being held as a portable and hand-held device, affixed to the dashboard in an automobile, or installed into the automobile at the time of manufacture. Furthermore, the COV device 105 is equipped with hardware that supports the use of a commercially available cable that connects to the OBD-II 140 through the connector 145 in the same manner that commercially available devices access an OBD-II system. The COV device 105 is operable to access and communicate with the OBD-II 140 through the connector 145. The OBD-II 140 provides access through use of functions similar to commercially available tools or applications. The access functions can also be provided from a PC or laptop computer, much like commercially available software solutions (e.g., AutoTap). When the device is operable, it is connected to the OBD-II system to access real-time information to produce real-time COV metric information.

In one embodiment of the invention, as depicted in the example system 100 shown in FIG. 1, the COV device 105 is represented by a hand-held, portable electronic device that the driver 155 carries with him into the automobile 150. The COV device 105 is comprised of an ODB-II access unit 110, a COV computation unit 115, a COV storage unit 120, a COV display unit 125, and optionally, a COV communication unit 130. The functionality of COV device 105 is supported by these units (110, 115, 120, 125, 130) and the COV device 105 is responsible for coordinating their functions to produce COV metric information. However, in this embodiment, the COV device 105 is not equipped with the COV communication unit 130. The display unit 125 is one contemplated example of a notification unit. It is understood that the notification unit may take any number of forms for notifying a user, including audible or visual notification systems.

When the invention is in use, the driver 155 first connects the COV device 105 to the connector 145, using well-known methods in the art, to access the OBD-II 140 for real-time automobile information (OBD-II data) when the driver 155 operates his automobile 150. Once the driver 155 connects COV device 105 to the OBD-II 140, the OBD-II 140 uses the OBD-II access unit 110 to establish a connection with the OBD-II 140 and obtain data. The OBD-II access unit 110, using processes and applications readily known in the art, establishes a connection between the COV device 105 and OBD-II 140 associated with the automobile 150. The OBD-II access unit 110 uses known methods or processes to obtain OBD-II data when the COV device 105 is in use.

Once the automobile 150 is in operation, the COV device 105 accesses real-time data from the OBD-II 140. Next, as the COV device 105 obtains data, it is stored by the COV device's 105 OBD storage unit 120, which is responsible for retrieval and storage of OBD-II data and COV metric information.

The COV device 105 provides the OBD-II data to the COV computation unit 115, which is responsible for computing the COV metric information from the OBD-II data. After the COV computation unit 115 computes the metric information, the COV device 105 stores the COV metric information, utilizing the COV storage unit 120. The COV storage unit 120 is responsible for storage and retrieval of information used by COV device 105, including COV metric information.

Next, the COV device 105 provides the COV display unit 125 to display real-time information, including the COV metric information, on the device 105. In this embodiment, the COV device 105 displays metric information showing the COV, COV per second, and COV per mile. The driver 155, who is in close proximity to the hand-held COV device 105 can read the COV metric information. While in operation, the COV device 105 continually displays the COV metric information as it changes. The driver 155 may then make better-informed decision about driving efficiency based on the COV metric information. The driver 155 may further modify driving habits to improve efficiency as reflected in the COV metric information. It is contemplated that this system 100 may be particularly useful in reducing traffic or highway congestion when the invention is utilized by multiple drivers, whose individual improvements in driving efficiency will collectively improve the driving efficiency on highway systems.

In another embodiment of the invention, the COV device 105 is represented as the COV device 105 described in the previous embodiment, but additionally includes the optional COV communication unit 130. The COV communication unit 130 is equipped with communication capabilities that allow the COV device 105 to communicate COV metric information with other electronic devices or systems, such as a preexisting traffic management system 160. The COV device's 105 communication capabilities are supported by use of any suitable communication protocol that allows communication with a desired external device or system. The communication protocol includes Wi-Fi (e.g., an 802.11 protocol), Bluetooth, infrared, cellular protocols, VOIP, RFID, or any other suitable protocol. The COV communication unit 130 is responsible for communicating the COV metric information to external electronic devices and systems. The COV communication unit 130 handles receipt of information from an external device or system that is operable to communicate with the COV device 105.

In one example, a preexisting traffic management system 160, such as the one depicted in the system 100 of FIG. 1, regulates traffic for a specific zone on an automobile highway by utilizing COV metric information communicated by each automobile opting to use a COV device in the regulated zone. In one instance, the traffic management system 160 can incentivize efficient traffic flow by posting a sign alerting the automobile 150 to optimize their COV value associated with the COV metric information provided by the automobile 150 driving through the regulated zone.

In the current example, the driver 155 turns on the power source to his COV device 105 and connects his COV device 105 to his automobile's OBD-II system 140 using the connector 145. The COV device 105 accesses the OBD-II system 140 through the OBD-II access unit 110. The driver 155 then begins operation of his automobile 150, at which point the COV device 105 begins to operate and utilize its functional units (110, 115, 120, 125) to produce real-time COV metric information. The information is stored by the COV storage unit 120 and continuously displayed on the COV device 105 by assistance from the COV display unit 125. In this embodiment, the device 105 displays the COV value, the COV value per second, and the COV value per mile.

Then, the driver 155 operates his automobile 150 in a special zone regulated by a traffic management system 160 with an integrated feebate system. The COV device 105 continues to produce COV metric information based on real-time OBD-II information obtained from the automobile 150. At the point when the driver 155 exits the special zone, a possible incentive is calculated and transferred to an account associated with the driver 155.

The traffic management device 165 is an electronic device, which is connected to the traffic management system 160 and is operable to communicate with the COV device 105 on behalf of the traffic management system 160. The device 165 has communication capabilities that support communication with the COV device 105. Additionally, the device includes an electronic display board that displays an incentive amount and the COV value used to compute the incentive.

In this embodiment, the traffic management device 165 communicates with the COV device 105 through RFID to request the COV metric information of the automobile 150 from COV device 105. In this instance, the COV device 105 communicates with the traffic management device 165 when both devices (105, 165) are within an operable range of communication for RFID. The COV device 105, which stores COV metric information, utilizes the COV storage unit 120 to retrieve the requested information. The COV device 105 utilizes the COV communication unit 130 to communicate the COV metric information to the traffic management device 165 over RFID.

The traffic management system 160 determines the appropriate incentive based on the COV metric information captured for a specific period of time and distance when the driver 155 entered the special zone. With the goal of reducing traffic congestion, the traffic management system requests a higher incentive reflected by a lower COV metric, which indicates a more efficient operation of the automobile 150 for the specific period of time and distance. The traffic management system 160 communicates the incentive and the COV metric information with the driver 155 through the electronic display board on the traffic management device 165.

The application of the COV metric information may serve to reduce traffic by rewarding more efficient drivers This example is one of many practical applications for use of the COV metric information, which can be used to inform and help drivers optimize their driving efficiency.

Figure 7:
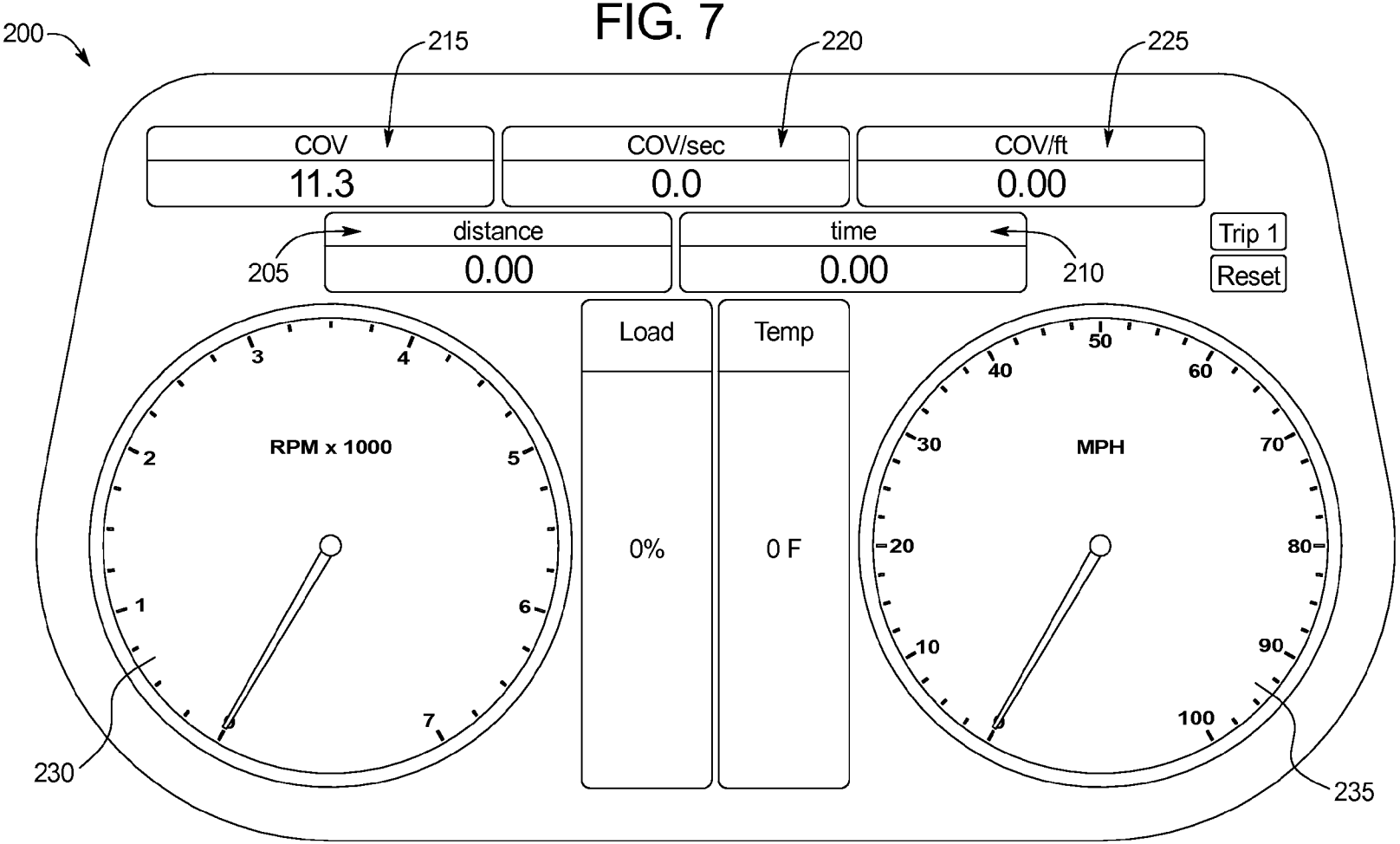
FIG. 7 is a representation of a vehicle dashboard incorporating COV metric information displays.

In yet another example, it is contemplated that the COV electronic device 105 may be further integrated into the vehicle 150 such that there is no "external" COV electronic device 105. For example, as shown in FIG. 7, an automobile 150 may include a dashboard 200 into which one or more COV metric information displays are provided. In the example shown, there is a distance display 205, a time display 210, a COV display 215, a COV/sec display 220, and a COV/ft display 225. In this example, the COV electronic device 105 is integrated within the automobile 150 and the driver 155 may view the COV metrics on the dashboard 200 as easily as the driver 155 might view the tachometer 230 and speedometer 235. In other examples, the information required to compute the COV may be communicated to a COV electronic device 105 through an interface other than the OBD-II 140.

While the example shown in FIG. 7 is a plurality of visual displays providing COV information to a driver, it is contemplated that various notification units may be employed in the system 100. For example the system 100 may include a notification unit that provides an audible signal or notification associated with the COV information. For example, the notification unit may signal an alarm when the COV information crosses a predetermined threshold level.

In a further example, the COV information may be used in the operation of unmanned vehicles, robotic vehicles and other vehicles that are not human operated/driven. It is believed that the COV metric may be an important element of the artificial intelligence algorithm for non-human operators.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. A system for monitoring a vehicle's contribution to the efficiency of flow and throughput in traffic comprising:

a computation unit that determines the coefficient of volatility, including a calculation of a summation of the magnitude of the ratio of two or more incremental velocity data points; and a notification unit that provides a notification related to the determined coefficient of volatility.

2. The system of claim 1 wherein the notification unit is a display that displays a visual representation of the coefficient of volatility.

3. The system of claim 2 wherein the display displays a visual representation of the coefficient of volatility over a period of time.

4. The system of claim 2 wherein the display displays a visual representation of the coefficient of volatility over a distance.

5. The system of claim 1 wherein the notification unit provides an audible notification related to the coefficient of volatility.

6. The system of claim 1 further including a sensor that determines the velocity of the vehicle and provides the velocity to the computation unit.

7. The system of claim 6 wherein the sensor communicates with the computation unit through an onboard computer.

8. The system of claim 1 wherein the computation unit and the notification unit are integrated into the vehicle.

9. The system of claim 1 wherein the computation unit and the notification unit are provided in a stand-alone device.

10. The system of claim 1 wherein the computation unit and notification unit are embodied in a mobile application provided in a mobile device.

11. The system of claim 1 further including a communication unit adapted to communicate with another electronic device.

12. The system of claim 11 wherein the other electronic device is included in a traffic management system.

13. A method of monitoring a vehicle's contribution to the efficiency of flow and throughput in traffic comprising the steps of:

calculating, in a computation unit associated with the vehicle, the coefficient of volatility, including a calculation of a summation of the magnitude of the ratio of two or more incremental velocity data points determined by a sensor; and displaying a visual representation of the calculated coefficient of volatility.

14. The method of claim 13 wherein the step of displaying a visual representation of the calculated coefficient of volatility includes displaying a visual representation of the coefficient of volatility over a period of time.

15. The method of claim 13 wherein the step of displaying a visual representation of the calculated coefficient of volatility includes displaying a visual representation of the coefficient of volatility over a distance.

16. The method of claim 13 wherein the step of displaying a visual representation of the calculated coefficient of volatility is performed by a display, further wherein the computation unit and the display are integrated into the vehicle.

17. The method of claim 13 wherein the step of displaying a visual representation of the calculated coefficient of volatility is performed by a display, further wherein the computation unit and the display are provided in a stand-alone device.

18. The method of claim 13 wherein the step of displaying a visual representation of the calculated coefficient of volatility is performed by a display, further wherein the computation unit and the display are embodied in a mobile application provided in a mobile device.

19. The method of claim 13 further including the step of communicating the calculated coefficient of volatility with another electronic device.

20. A system for monitoring a vehicle's contribution to the efficiency of flow and throughput in traffic comprising:

a computation unit that determines the coefficient of volatility, including a calculation of a summation of volatility readings over a time or distance interval, wherein the volatility readings are taken consecutively over the interval, and wherein the volatility readings include a calculation of the ratio between two velocity readings taken during the interval; and a notification unit that provides a notification related to the determined coefficient of volatility.

* * * * *